United States Patent [19]

Bessett et al.

[11] 4,087,040

[45] May 2, 1978

[54] MOLDED CONTAINER FOR FRAGILE ARTICLES

[75] Inventors: Clifford H. Bessett, South Holland, Ill.; James W. Boyd, Crown Point, Ind.; Theodore H. Misdom, Jr., Lansing, Ill.

[73] Assignee: Packaging Corporation of America, Evanston, Ill.

[21] Appl. No.: 744,382

[22] Filed: Nov. 23, 1976

[51] Int. Cl.[2] ..... B65D 1/00; B65D 81/16; B65D 85/32

[52] U.S. Cl. ..... 229/2.5 EC; 229/29 M; 229/44 R

[58] Field of Search ..... 229/2.5 EC, 29 M, 44 R; 217/26.5, 26

[56] References Cited

U.S. PATENT DOCUMENTS

| | | | |
|---|---|---|---|
| 3,207,409 | 9/1965 | Reifers et al. | 229/2.5 EC |
| 3,664,574 | 5/1972 | Pearl et al. | 229/2.5 EC |
| 3,920,178 | 11/1975 | Moller | 229/2.5 EC |

*Primary Examiner*—Davis T. Moorhead

*Attorney, Agent, or Firm*—Neuman, Williams, Anderson & Olson

[57] ABSTRACT

A molded container for a plurality of fragile articles (e.g. eggs) is provided which includes a tray section having a plurality of pockets arranged in elongated substantially parallel rows. Disposed intermediate adjacent rows of pockets are a plurality of upwardly extending hollow posts. Each of a predetermined number of the posts has a plurality of elongated wall panels. The opposite elongated upright edges of each wall panel are hingedly connected to corresponding edges of adjacent wall panels whereby the panel or panels is yieldable about the hingedly connected edges thereof when a predetermined external transverse force is applied thereto. The lower portion of each wall panel forms a segment of a surface defining an adjacent pocket.

5 Claims, 6 Drawing Figures

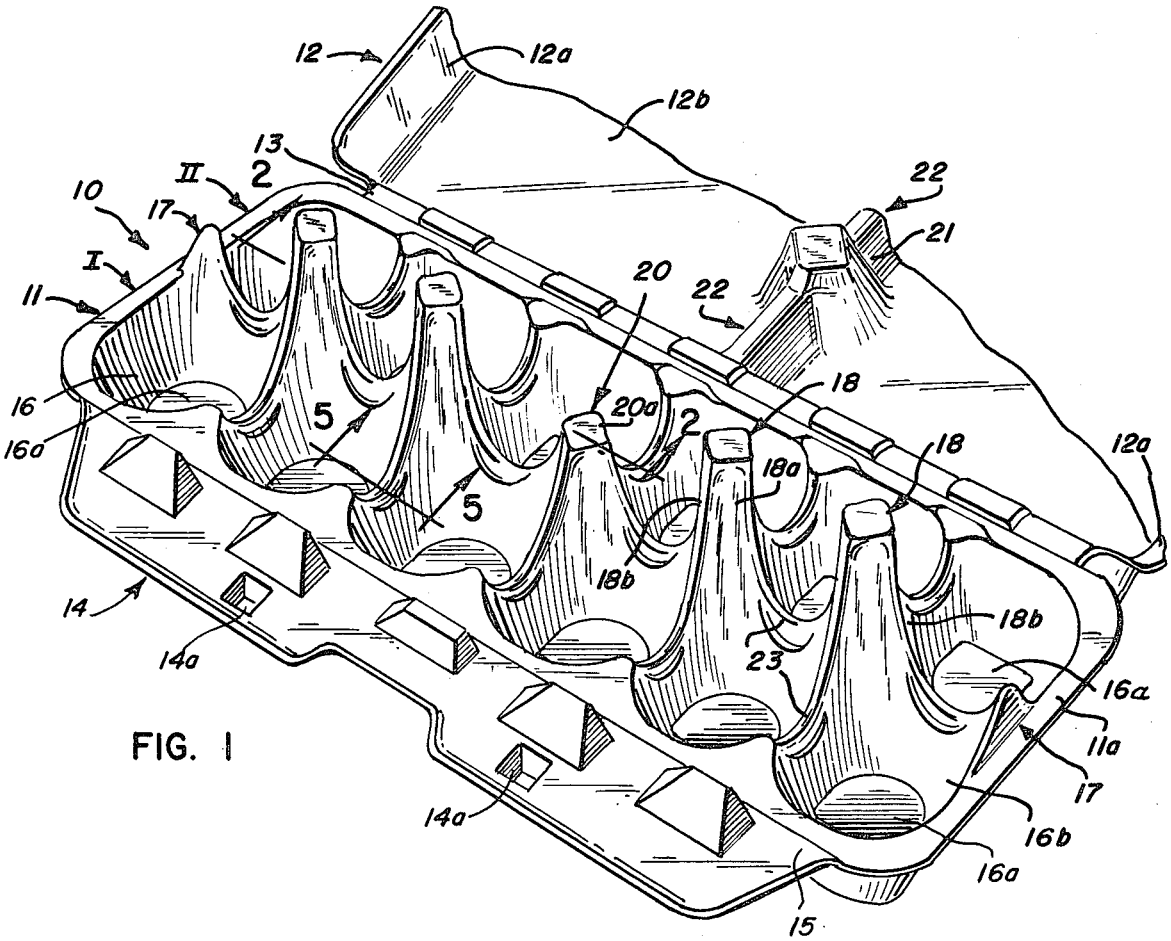
FIG. 1
FIG. 2
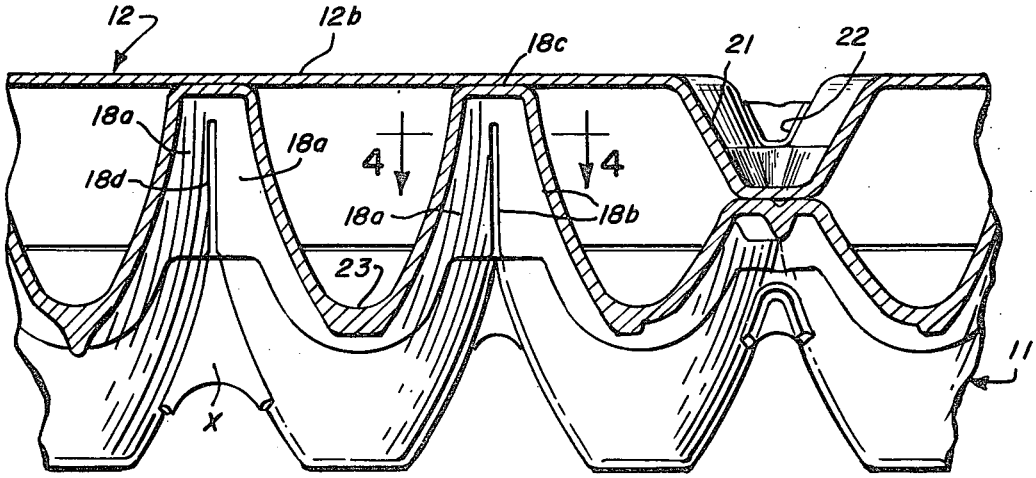

FIG. 4
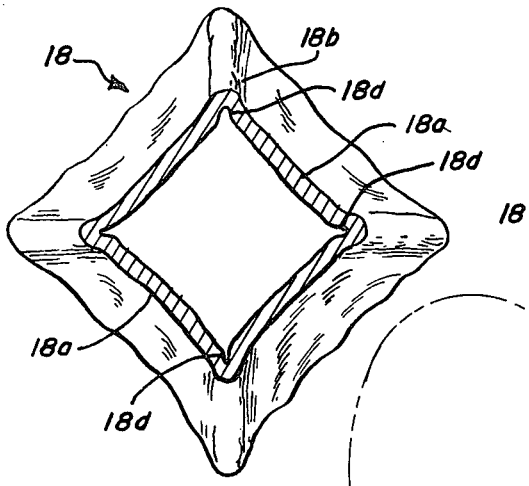
FIG. 4a
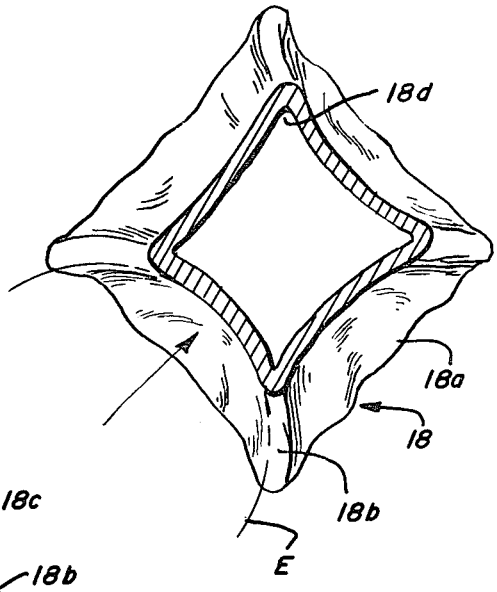
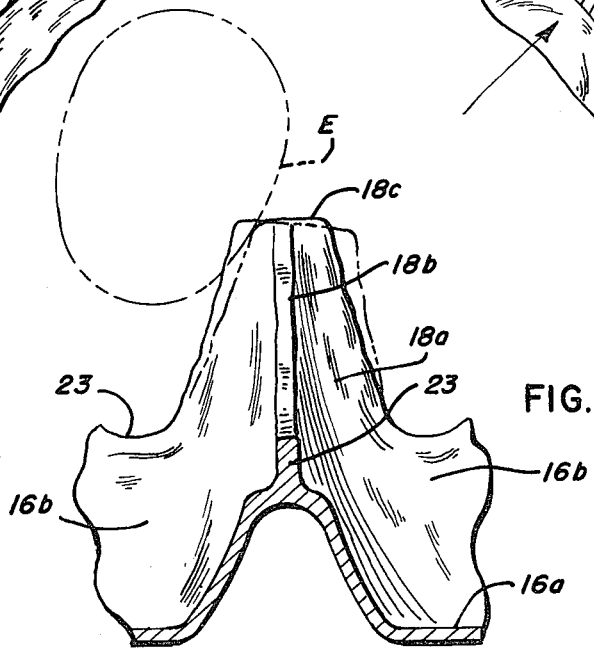
FIG. 5
FIG. 3
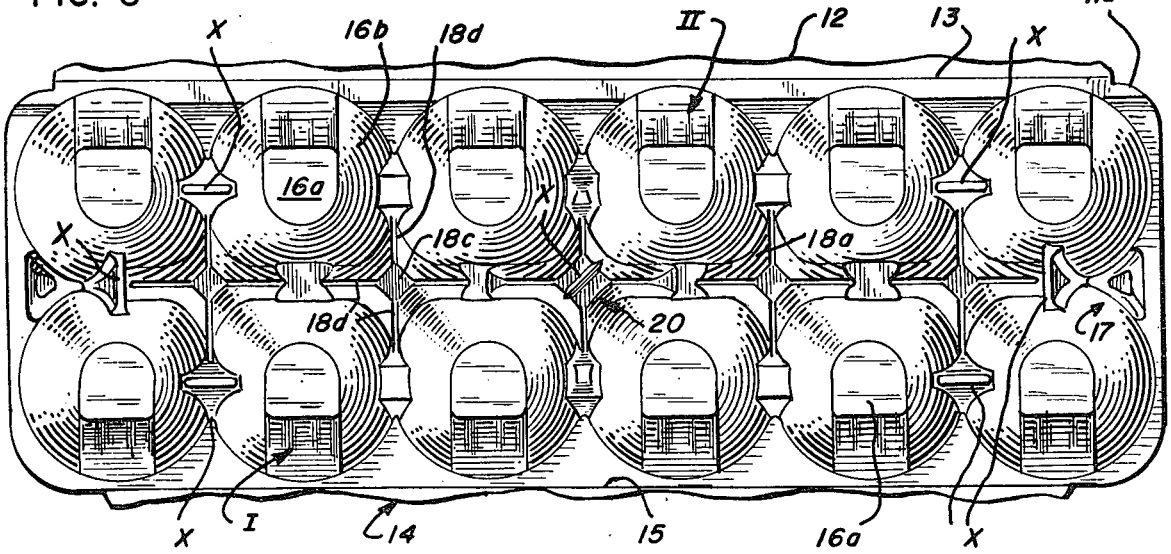

MOLDED CONTAINER FOR FRAGILE ARTICLES

BACKGROUND OF THE INVENTION

In the automatic loading of a molded container with a plurality of fragile articles, such as eggs, the latter oftentimes strike the exterior of the hollow posts which are disposed adjacent the pocket being filled with the egg. By reason of this contact the egg is frequently cracked or otherwise damaged and the container becomes soiled thereby rendering the loaded container unmarketable.

In order to reduce the incidents of egg damage due to the aforementioned cause, various post constructions have heretofore been utilized wherein portions of the wall panels are of reduced thickness of material or are slotted, slit or otherwise deformed so as to render the wall panel more yieldable to the impact of the egg. Such prior post constructions; however, have been found to be inherently weak and ineffective as supports for the cover section of the container when loaded containers are stacked thereon. Furthermore, the formation of such post wall panels oftentimes requires costly equipment and the utilization of complex molding techniques.

SUMMARY OF THE INVENTION

Thus, it is an object of the invention to provide an improved molded container embodying in a tray section hollow posts having yieldable wall panels which materially reduce the incidents of article damage and, yet, enable the posts to effectively support the underside of a cover section of the container when a plurality of loaded containers are stacked thereon.

It is a further object of the invention to provide an improved molded container embodying hollow posts, each having hingedly interconnected wall panels which are of unitary construction and of substantially uniform thickness throughout.

Further and additional objects will appear from the description, accompanying drawings and appended claims.

In accordance with one embodiment of the invention, an improved molded container is provided which includes a tray section having a plurality of article-accommodating pockets arranged in elongated substantially parallel rows. A plurality of hollow upright posts are disposed intermediate the rows of pockets. Certain of the posts include interconnected elongated wall panels. The opposite elongated upright edges of each wall panel are hingedly connected to corresponding edges of adjacent wall panels. The lower portion of each wall panel forms a segment of the surface defining an adjacent pocket. The opposite elongated edges of each wall panel extend convergently upwardly from the adjacent pocket. By reason of the hinge connections between adjacent wall panels of a post, each wall panel or panels will yield when a predetermined external transverse force is applied thereto by a fragile article when the latter is being accommodated in an adjacent pocket, thereby reducing the deleterious effect that such force might otherwise have on the article.

DESCRIPTION

For a more complete understanding of the invention reference should be made to the drawings wherein:

FIG. 1 is a fragmentary perspective view of one form of the improved molded container showing the cover section thereof in open relation with respect to the tray section.

FIG. 2 is an enlarged fragmentary sectional view taken along line 2—2 of FIG. 1, and showing the cover section in a closed position.

FIG. 3 is a bottom view of the tray section shown in FIG. 1.

FIG. 4 is a fragmentary sectional view taken along line 4—4 of FIG. 2.

FIG. **4*a* is similar to FIG. 4** but showing the wall panels of a post yielding to an external force being applied thereto in the direction of the arrow.

FIG. 5 is a fragmentary sectional view taken along line 5—5 of FIG. 1.

Referring now to the drawings and more particularly to FIG. 1, a preferred embodiment of the improved container 10 is shown which is in the form of a molded 2 × 6 egg carton. Paper pulp or molded plastic may be utilized in forming the improved container. The illustrated container 10 includes a tray section 11, a cover section 12 hingedly connected at 13 to the adjacent rear edge of a ledge **11*a* delimiting the open side of the tray section 11. A locking flap 14 is hingedly connected at 15 to the front edge of ledge 11*a*. The locking flap 14 may be provided with a pair of spaced protuberances 14*a* which are adapted to interlock with corresponding openings formed in a depending front wall, not shown, of the cover section 12 when the latter assumes an overlying closed position with respect to the open side of the tray section, as seen more clearly in FIG. 2. The cover section 12 and the locking flap 14** form no part of the invention hereinafter described and claimed.

The tray section, cover section and the locking flap are preferably of unitary construction.

The tray section 11 is provided with a plurality egg pockets or cells 16 of like configuration which are arranged in either two or more parallel rows. As shown in FIG. 1, when there are two rows I and II, each row comprises six pockets or cells of like configuration, which are uniformly spaced and in rectilinear alignment. Each pocket has a bottom portion **16*a* which is adapted to rest upon a supporting surface, not shown. Delimiting base portion 16*a* is a substantially conical surface 16*b* which extends outwardly and upwardly from portion 16*a* and is adapted to encompass the lower exterior portion of an egg or similar fragile article, when the latter is accommodated within the pocket. Disposed between the adjacent rows I and II of pockets are a plurality of hollow upstanding posts 17, 18 and 20. Posts 17 are normally referred to as end posts and are the shortest of the posts. Posts 17 are of conventional design and serve to prevent lateral endwise displacement of the cover section 12 when the latter is moved into and is disposed in the closed position. The tops of the end posts 17 may engage a depending shoulder, not shown, when the latter is formed in the end wall 12*a* of the cover section 12**. The end posts form no part of the claimed invention.

The center post 20 in the illustrated container 10 is a half post and has a height less that the posts 18 disposed between the center post and the end posts 17. The top **20*a* of post 20 is adapted to supportingly engage the bottom of a depending post 21 formed centrally of the top panel 12*b* of the cover section 12. Formed in panel 12*b* and extending outwardly from opposite sides of post 21 and disposed transversely of the hinge connection 13 between the tray and cover sections is a pair of hollow depending reinforcing ribs 22. The depending post 21 and ribs 22 formed in the top panel 12***b* of the cover section 12 are not essential in practicing the invention hereinafter disclosed. If no such post and ribs are formed in the cover section top panel, then center post 20 of the tray section may have the same size and shape as posts 18.

As seen in FIG. 2, the height of each post 18 is such that it supportingly engages the underside of the cover section top panel 12*b*, when the cover section is in a closed position. Each post 18 is of like configuration and is formed of four elongated wall panels 18*a* having the elongated side edges thereof integrally connected to corresponding edges of adjacent wall panels so as to form corner hinges 18*b*, see FIG. 4. The lower portion of each wall panel 18*a* smoothly merges into and forms a segment of the conical surface 16*b* defining the adjacent pocket 16. The posts 18 in the illustrated embodiment are disposed intermediate four pockets, whereby the opposite wall panels of a post 18 form surface segments of diagonally disposed pockets, each of which is included in a separate row of pockets.

The elongated side edges of each wall panel 18*a* extend upwardly from a pocket and converge slightly towards one another and form a substantially flat top surface 18*c*. It is surface 18*c* which supportingly engages the underside of the cover section top panel 12*b*, see FIG. 2.

The corner hinges 18*b* are formed by elongated indentations 18*d* impressed on the concealed or interior surface of the post when the container is being formed on molding dies or the like. The indentations 18*d* are observable when the tray section 11 is viewed from the underside as seen more clearly in FIG. 3. The exposed portions of the hinges 18*b* extend upwardly from saddlelike ribs 23, which are disposed between adjacent pockets in a row or between corresponding pockets in adjacent rows. The hinges 18*b* extend to approximately the top surface 18*c* of the post. The narrow elongated indentations 18*d* of the posts permit the wall panels 18*a* of a post to flex or become partially distorted, when the exterior thereof is struck by an egg or other fragile article while being loaded into an adjacent pocket 16 during the operation of automatic high speed egg loading equipment, not shown. The operation of such equipment is well understood in the egg packing art. By reason of the wall panels 18*a* flexing or partially distorting, the shock of the contact between the egg and post is substantially absorbed by the post rather than the egg itself, see FIG. 4*a*, and, thus, the integrity of the egg shell is preserved. As will be noted in FIG. 4, the size and thickness of the wall panels 18*a* are substantially uniform throughout. Also, it will be noted in FIG. 4 that the corner hinges 18*b* are of substantially uniform thickness. Thus, when an external force is applied to the exterior of the post, such as might be produced by an egg E being dropped into a pocket by the automatic loading equipment, one or more of the wall panels and the corner hinges connecting same will flex or distort thereby absorbing shock from the egg and prevent the egg from rebounding from the post and clicking or striking against an egg already accommodated in or being simultaneously accommodated in an adjacent pocket.

The flexibility of the post wall panels also enables the tray sections to be nested more deeply when the cartons are in an unfolded condition, thereby resulting in more compact stacks or bundles of unfolded cartons which are more suitable for storage or shipment. In such a situation, the wall panels of the overlying posts are capable of being distorted outwardly or expanded slightly by the posts of the subtending tray sections. Furthermore, in such a compact stack the posts of the bottom tray are unsupported on the underside thereof and, thus, the flexibility of the post wall panels permits such posts to collapse inwardly a slight amount giving rise to certain forces acting upon the posts of the bottom tray section which will facilitate the denesting of the bottom carton. As a further denesting aid, a plurality of deeply depending solid denesting lugs or ribs X are formed and strategically located on the underside of the tray section, particularly at the opposite end portions of the tray sections as seen in FIG. 3. It has been found through experience that the end portions of the nested tray sections are most susceptible to jamming due to excessive forces being applied thereto by reason of the stack or bundle being dropped or otherwise abused during handling. The deeply depending lugs serve therefore to resist such forces and minimize the jamming effect.

Thus, it will be noted that a molded container has been provided in which parallel rows of pockets formed in the tray section thereof are separated from one another by a plurality of hollow upwardly extending posts. The wall panels and the interconnection between the wall panels of certain of the posts are flexible and thus, readily absorb the shock caused by an external transverse force applied thereto by a fragile article or the like when the latter is being loaded into a pocket disposed adjacent to the post. The wall panels of each post are of uniform thickness and are hingedly connected to one another and extend upwardly so that the tops of the posts will supportingly engage the underside of the cover section when the latter is disposed in a closed position. Furthermore, the uniform thickness of the wall panels and the hinge connections facilitate and simplify the forming of the container. The improved post design embodies flexible structural characteristics which overcome denesting problems commonly associated with prior containers or cartons embodying tall hollow posts in the tray sections thereof.

We claim:

1. A molded container for a plurality of fragile articles, comprising a tray section provided with a plurality of article-accommodating pockets arranged in substantially parallel rows, and a plurality of hollow upstanding posts disposed intermediate the pocket rows; a predetermined number of posts each having a plurality of panels, each panel being of substantially uniform thickness throughout and having opposite elongated upright edges thereof hingedly connected to corresponding edges of adjacent panels and forming elongated corners whereby the panel is substantially laterally shiftable about the hingedly connected corner edges thereof when a predetermined transverse force is applied thereto, the lower end portion of each wall panel forming a segment of a surface defining an adjacent pocket.

2. The molded container of claim 1 wherein the elongated opposite edges of each wall panel extend convergently upwardly from the surface segment of the adjacent pocket.

3. The molded container of claim 1 wherein each of the predetermined number of posts is provided with four wall panels and alternate wall panels are disposed opposite one another; corresponding pockets of adjacent rows are in transverse alignment with one another.

4. The molded container of claim 1 including a cover section adapted to overly the tray section; the underside of the cover section, when overlying said tray section, being supportingly engaged by the predetermined number of posts of said tray section.

5. The molded container of claim 1 wherein the wall panels of each of the predetermined number of posts are of like configuration and are symmetrically arranged about a centrally disposed upright axis; the concealed portion of each hinge connection between adjacent wall panels being provided with an elongated upright narrow indentation.

* * * * *